US009238938B2

(12) United States Patent
Sherman

(10) Patent No.: US 9,238,938 B2
(45) Date of Patent: Jan. 19, 2016

(54) LIGHT BLOCKING SIDE VALANCE FOR WINDOW TREATMENTS

(71) Applicant: Brand Awareness, Inc., Miami, FL (US)

(72) Inventor: Jeremy Sherman, Miami, FL (US)

(73) Assignee: Brand Awareness, Inc., Miami, FL (US)

( * ) Notice: Subject to any disclaimer, the term of this patent is extended or adjusted under 35 U.S.C. 154(b) by 0 days.

(21) Appl. No.: 14/801,378

(22) Filed: Jul. 16, 2015

(65) Prior Publication Data

US 2015/0322713 A1 Nov. 12, 2015

Related U.S. Application Data

(62) Division of application No. 14/221,317, filed on Mar. 21, 2014, now Pat. No. 9,115,532.

(51) Int. Cl.
*E06B 9/00* (2006.01)
*E06B 9/24* (2006.01)

(52) U.S. Cl.
CPC ..... *E06B 9/24* (2013.01)

(58) Field of Classification Search
CPC ..... E04F 19/0486; E04F 19/064; E06B 2001/628; E06B 1/34; E06B 9/327; E06B 9/24
USPC ..... 160/40, 172 R, 84.06, 267.1, 268.1
See application file for complete search history.

(56) References Cited

U.S. PATENT DOCUMENTS

| | | | | |
|---|---|---|---|---|
| 4,114,233 | A | 9/1978 | Hamilton | |
| 4,220,189 | A | 9/1980 | Marquez | |
| 4,289,818 | A | 9/1981 | Casamayor | |
| 4,335,550 | A | 6/1982 | Johnson | |
| 5,653,072 | A | 8/1997 | Seelandt-Stasek et al. | |
| 5,769,562 | A | 6/1998 | Jones | |
| 6,269,591 | B1 | 8/2001 | Kelly | |
| 6,848,220 | B2 | 2/2005 | Faurholdt et al. | |
| 8,109,052 | B2 * | 2/2012 | Rosende | E06B 1/6015 52/204.53 |
| 8,113,264 | B2 | 2/2012 | Kirby et al. | |
| 2012/0012261 | A1 | 1/2012 | Santoro et al. | |
| 2013/0048230 | A1 | 2/2013 | Marocco | |
| 2014/0033610 | A1 | 2/2014 | Watkins et al. | |

FOREIGN PATENT DOCUMENTS

| | | | |
|---|---|---|---|
| DE | 102011015783 | A | 10/2012 |
| EP | 0725885 | A | 8/1996 |
| EP | 2290189 | A | 3/2011 |

* cited by examiner

*Primary Examiner* — Brian Glessner
*Assistant Examiner* — Gisele Ford
(74) *Attorney, Agent, or Firm* — Mayback & Hoffman, P.A.; Gregory L. Mayback

(57) ABSTRACT

A method of preventing light from passing through a gap between a window frame and a window treatment disposed in the window frame, the window frame having a window opening and vertical sides includes the steps of providing an L-shaped light-blocking device with a mounting face, a retaining face extending substantially perpendicular to the mounting face, and at least one frangible width adjustment notch disposed lengthwise along the retaining face, and attaching the mounting face to one of the vertical sides of the window frame to have the retaining face extend from the vertical side between the window treatment and the window opening and block at least some light passing between the window frame and the window treatment.

20 Claims, 5 Drawing Sheets

LIGHT BLOCKING SIDE VALANCE FOR WINDOW TREATMENTS

CROSS-REFERENCE TO RELATED APPLICATIONS

This application is a divisional of U.S. patent application Ser. No. 14/221,317, filed on Mar. 21, 2014, the entire disclosure of which is hereby incorporated herein by reference in their entirety.

STATEMENT REGARDING FEDERALLY SPONSORED RESEARCH OR DEVELOPMENT

N/A

BACKGROUND OF THE INVENTION

1. Field of the Invention

The present invention generally relates window treatment components and more specifically to a light blocking side valance or trim piece for use in conjunction with any type of window treatment.

2. Description of Related Art

Window treatments such as a slat blinds, venetian blinds, mini blinds, roller blinds, blackout shades, roman shades and the like are useful for providing privacy and blocking incoming light from a window. However, the complex mounting hardware and actuators needed for the window treatment to operate effectively typically requires the shade portion of the treatment to be somewhat narrower than the actual window opening in which the treatment is installed. For example, in the case of a typical roller shade, mounting brackets must be secured at the top of the window opening and protrude out into the opening at least ½" on each side. Thus, in order for the roller blind to fit into the bracket and function properly, the shade is offset from either side of the window opening, leaving at least a ½" edge gap through which unwanted light can pass through. The same problem is true for venetian blinds, roman shades, and other window treatments where the mounting hardware is placed inside the window opening (typically at the top edge of the opening). The gap at either side may be even more significant if the window treatment includes complex or large actuators such as turning rods, cords, and the like that require space accommodations. The resultant edge gap not only allows unwanted light to leak through but it also can result in a window treatment that appears unfinished or otherwise unsightly. Accordingly, there is a need in the art to provide a means to block unwanted light from leaking through at the sides of the window treatment while also maintaining a cohesive and attractive look.

Some attempts have been made to fill the space or gap at the edge of the windows left by window treatments; however, none are versatile enough to be used with any type of window treatment and installation configuration.

For example, U.S. Patent Application Publication No. 2013/0048230 to Marocco describes a window opening space filler used to adjust the window opening width to accommodate standard sized blinds in otherwise larger window openings. The filler includes a bracket piece affixed to the window opening and a filler member that attaches to the bracket piece and extends into the window opening so the user can reduce the width of the window opening at the side or edge thereof. The device is designed so the blind rides behind the filler member. The disadvantage of this arrangement is that the filler device requires two pieces and is completely visible because the blind rides behind the member. Further, only certain types of blinds such as roller blinds can be accommodated by the filler member without snagging because the blind rides behind the extended filler member. Multi-slat blinds will not function properly with this configuration because they do not have sufficient space behind the blind to rotate. Further still, because the blind rides behind the filler member, the blind will have a tendency to sway back toward the window which can again cause an edge gap that allows light to pass through.

U.S. Patent Application Publication No. 2012/0012261 to Santoro et al. describes a window shade assembly having a two-part side channel system including a side channel attachment piece and a trim piece that is received in a slot on the attachment piece. The shade is received in a cavity created by the two pieces and slides up and down therein. The device is designed to retain the blind so that it doesn't sway from front to back inside the window and is not necessarily designed to block light at the side edges. More importantly, because the blind must ride inside the small cavity between the attachment piece and the trim piece, the side channel can only accommodate roller blinds as slat or venetian blinds will not have sufficient space to rotate and open.

Accordingly, there is a significant need in the art for a light blocking solution that can be used with any type of blind in an aesthetically pleasing manner. It is, therefore, to the effective resolution of the aforementioned problems and shortcomings of the prior art that the present invention is directed. However, in view of the window treatment components in existence at the time of the present invention, it was not obvious to those persons of ordinary skill in the pertinent art as to how the identified needs could be fulfilled in an advantageous manner.

SUMMARY OF THE INVENTION

The present invention is a light-blocking device for a window treatment to fill gaps on either side of the window treatment and to retain the window treatment at a distance spaced away from the window. The device is configured as a side valance or trim piece comprising an L-shaped member having a mounting face and a retaining face, the retaining face extending substantially perpendicular from the mounting face. The side valance may be constructed as an extrusion of any length desired. At least one frangible width adjustment notch is disposed lengthwise along the retaining face for adjusting the width of the device by breaking it along the desired notch. The mounting face is attached to a side of a window opening such that the retaining face extends outwardly from the side of the window opening to block light and retain the window treatment. When installed in a window opening, the retaining face is configured to be disposed between the window treatment and the window to keep the treatment away from the wall while also closing the gaps between the window opening and the edges of the window treatment. The length and width adjustability allows the side valance to be used for virtually any window treatment installation and configuration.

In some embodiments, the side valance includes at least one frangible length adjustment notch disposed transversely across the valance similar to the width adjustment 20 notches but allowing the user to adjust the length of the piece to fit a wide variety of window openings. In some embodiments, a strip of protective material is disposed on an interior aspect of the side valance where the mounting face and the retaining face meet, in order to protect the window treatment as it moves up and down along the device.

Accordingly, it is an object of the present invention to provide a device that fills the gap commonly found between the sides of a window opening and a window treatment to prevent unwanted light from passing through the gap.

It is another object of the present invention to provide a device that retains a window treatment and spaces it away from the window for optimal stability, functionality, and aesthetics.

It is another object of the present invention to provide a gap filling, light-blocking, and retaining device for window treatments that can be used for any style of window treatment including roller blinds, roman shades, slat blinds, and the like without the need to reconfigure or rearrange the components of the window treatment.

It is another object of the present invention to provide a gap-filling, light-blocking device for window treatments that is adjustable in both length and width to accommodate the parameters of virtually any window treatment installation.

It is another object of the present invention to provide a gap-fill, light-blocking device for window treatments that can be retrofitted into existing window treatment installations easily and quickly.

With the foregoing and other objects in view, there is provided, a method of preventing light from passing through a gap between a window frame and a window treatment disposed in the window frame, the window frame having a window opening and vertical sides, the method including the steps of providing an L-shaped light-blocking device with a mounting face, a retaining face extending substantially perpendicular to the mounting face, and at least one frangible width adjustment notch disposed lengthwise along the retaining face, and attaching the mounting face to one of the vertical sides of the window frame to have the retaining face extend from the vertical side between the window treatment and the window opening and block at least some light passing between the window frame and the window treatment.

With the objects in view, there is also provided a method of preventing light from passing through a gap between a window frame and a window treatment disposed in the window frame, the window frame having a window opening and vertical sides, the method including the steps of providing a pair of L-shaped light-blocking devices each with a mounting face, a retaining face extending substantially perpendicular to the mounting face, and at least one frangible width adjustment notch disposed lengthwise along the retaining face, and attaching the mounting face of each of the light-blocking devices to one of the vertical sides of the window frame to have the retaining face respectively extend from the vertical side between the window treatment and the window opening and block at least some light passing between the window frame and the window treatment.

In accordance with another mode, the light-blocking device has a longitudinal extent, a transverse extent, and at least one frangible length adjustment notch disposed across at least a portion of the transverse extent.

In accordance with a further mode, each of the light-blocking devices has a longitudinal extent, a transverse extent and at least one frangible length adjustment notch disposed across at least a portion of the transverse extent.

In accordance with an added mode, the mounting face and the retaining face meet at a corner having an interior aspect and further comprising a strip of protective material disposed on the interior aspect of the corner.

In accordance with an additional mode, the retaining face is wider than the mounting face.

In accordance with yet another mode, the at least one frangible adjustment notch is substantially U-shaped and at least partially penetrates the retaining face.

In accordance with yet a further mode, the at least one frangible length adjustment notch is disposed across at least one of the transverse extent of the mounting face, the transverse extent of the retaining face, and the transverse extent of both the mounting face and the retaining face.

In accordance with yet an added mode, the at least one frangible adjustment notch is formed to break along the notch when a breaking force is applied at the retaining face.

In accordance with yet an additional mode, the attaching step is performed by attaching the mounting face to one of the vertical sides of the window frame to have the retaining face extend from the vertical side between the window treatment and the window opening and block at least some light passing between the window frame and the window treatment and retain the window treatment at the window frame.

In accordance with again another mode, there is provided the step of breaking the light-blocking device along the at least one frangible width adjustment notch to reduce a width of the retaining face.

In accordance with again a further mode, there is provided the step of breaking the light-blocking device along the at least one frangible length adjustment notch to adjust a length of the device to fit the vertical side of the window frame.

In accordance with again an added mode, two of the light-blocking devices are provided and the mounting face of each of the light-blocking devices is attached to one of the vertical sides of the window frame to have the retaining face respectively extend from the vertical side between the window treatment and the window opening and block at least some light passing between the window frame and the window treatment.

In accordance with a concomitant mode, there is provided at least one of the steps of breaking the light-blocking device along the at least one frangible width adjustment notch to reduce a width of the retaining face and breaking the light-blocking device along the at least one frangible length adjustment notch to adjust a length of the device to fit the vertical side of the window frame.

In accordance with these and other objects that will become apparent hereinafter, the instant invention will now be described with particular reference to the accompanying drawings.

DETAILED DESCRIPTION

Figure 1:
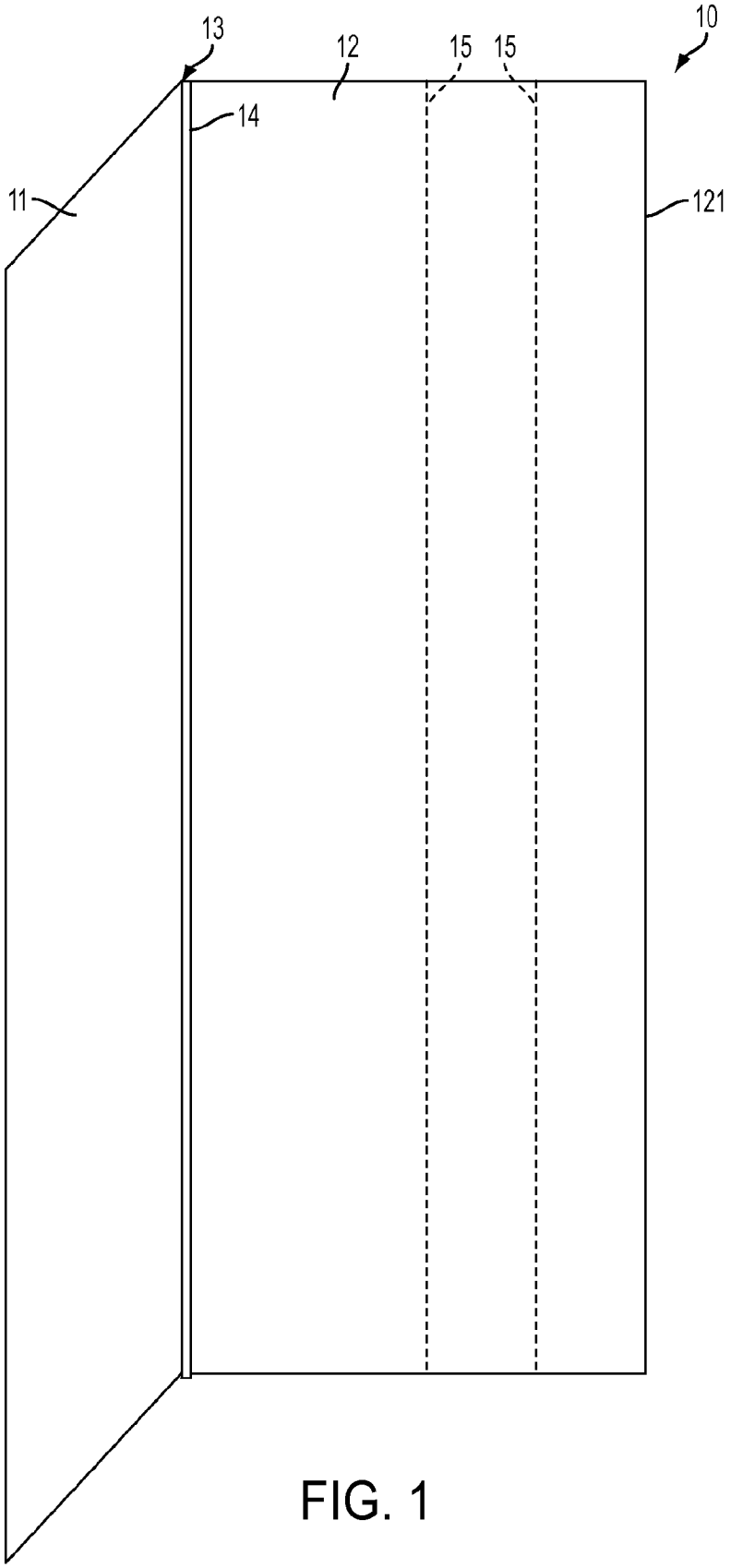
FIG. 1 is a front perspective view of one embodiment of the side valance of the present invention having width adjustment features.

FIG. 1 is a front perspective view of one embodiment of the side valance 10 of the present invention. Side valance 10 is designed as a trim piece device to block light between the edge of a window treatment and a window opening and retain the window treatment away from the window. Side valance 10 is generally configured as an L-shaped member of any desired length and width comprising a mounting face 11 and a retaining face 12 wherein the retaining face 12 is perpendicular to the mounting face 11. In some embodiments, the mounting face 11 and retaining 12 are generally planar rectangular bodies and the two faces 11 and 12 meet at corner 13 such that the retaining face extends from corner 13, terminating at outer edge 121. An interior aspect of corner 13 may be filled with a protective material 14 such as a felt, rubber, or other soft substance to prevent damage to the window treatment as further described here.

Figure 2:
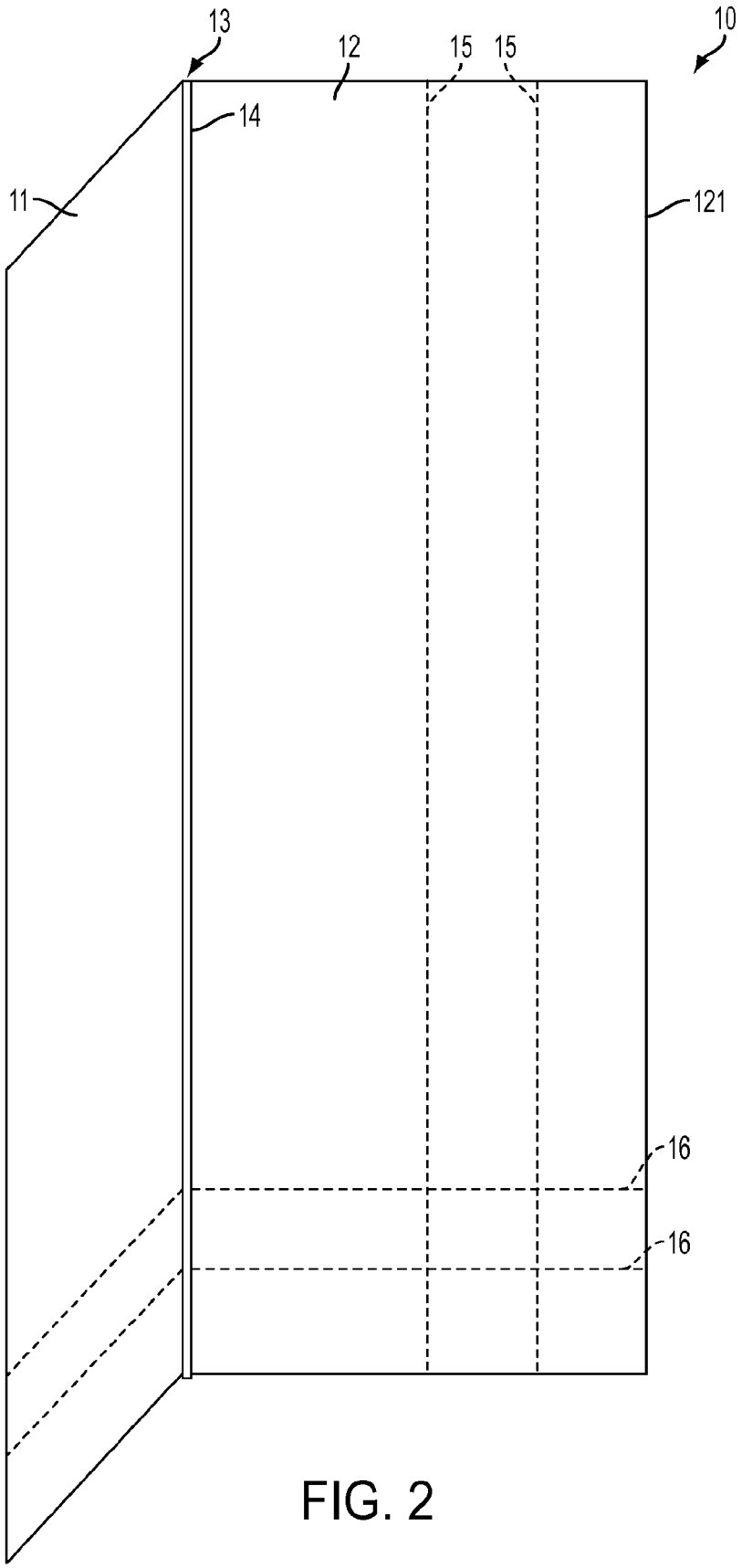
FIG. 2 is a front perspective view of another embodiment of the side valance of the present invention having a length and width adjustment features.

In some embodiments, the retaining face 12 is somewhat wider than the mounting face 11. Optionally provided lengthwise along the retaining face 12 are one or more frangible width adjustment notches 15. Width adjustment notches 15 are disposed at predetermined locations on the retaining face 12 and allow for adjustment of the width of the retaining face 12. Adjustment is accomplished by applying force to the retaining face 12 such that it breaks or snaps off at the desired width adjustment notch 15. This obviates the need to use a saw or power tool to cut the side valance 10 down to fit the particular parameters of an installation. FIG. 2 is a perspective view of another embodiment of the side valance 10. Here, the valance 10 further includes one or more length adjustment notches 16 disposed transversely across the side valance toward one end. These length adjustment notches 16 allow for adjustment of the length of the side valance by applying force to the end of the side valance 10 and breaking or snapping it at the desired notch 16. The depicted embodiments shown two width adjustment notches 15 and two length adjustment notches 16; however, any desired number of notches can be provided spaced apart at any desired increment.

Figure 3:
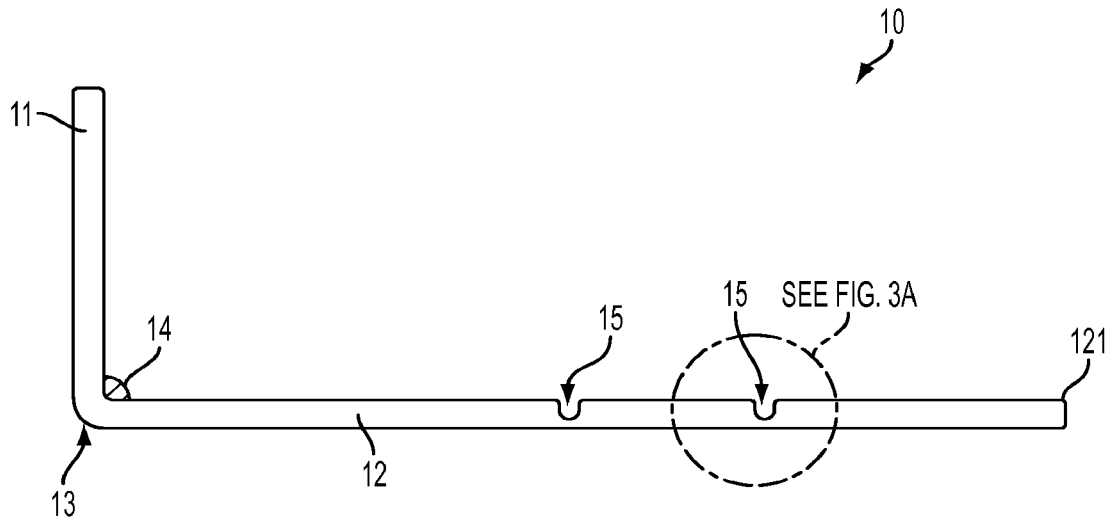
FIG. 3 is an end view of the side valance of the present invention showing the width adjustment feature.
Figure 3A:
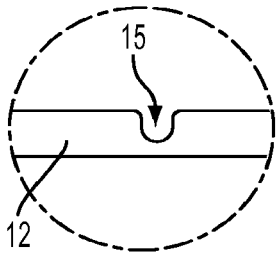
FIG. 3A is a close-up view of the width adjustment features shown in FIG. 3.

FIG. 3 is an end view of the side valance 10 again shown the mounting face 11 and retaining face 12. Here, corner 13 is shown as having a relatively rounded shape with the interior aspect including protective material 14. The profile of width adjustment notches 15 can be seen in FIG. 3 and more easily in close-up FIG. 3A as substantially U-shaped grooves running lengthwise along the side valance 10. In a preferred embodiment, the width adjustment notches 15 partially penetrate the surface of the retaining face 12 so that the valance 10 is easily frangible at the notches to provide a clean break and resultant edge. The length adjustment notches 16 shown in FIG. 2 may be similarly configured. It is appreciated that the notches 15 and 16 could be disposed on either side of the side valance 10. Also seen in the end view is protective material 14 disposed on the interior aspect of the corner 13 where the two faces 11 and 12 meet. The protective material preferably runs along the entire length of the side valance 10.

Figure 4:
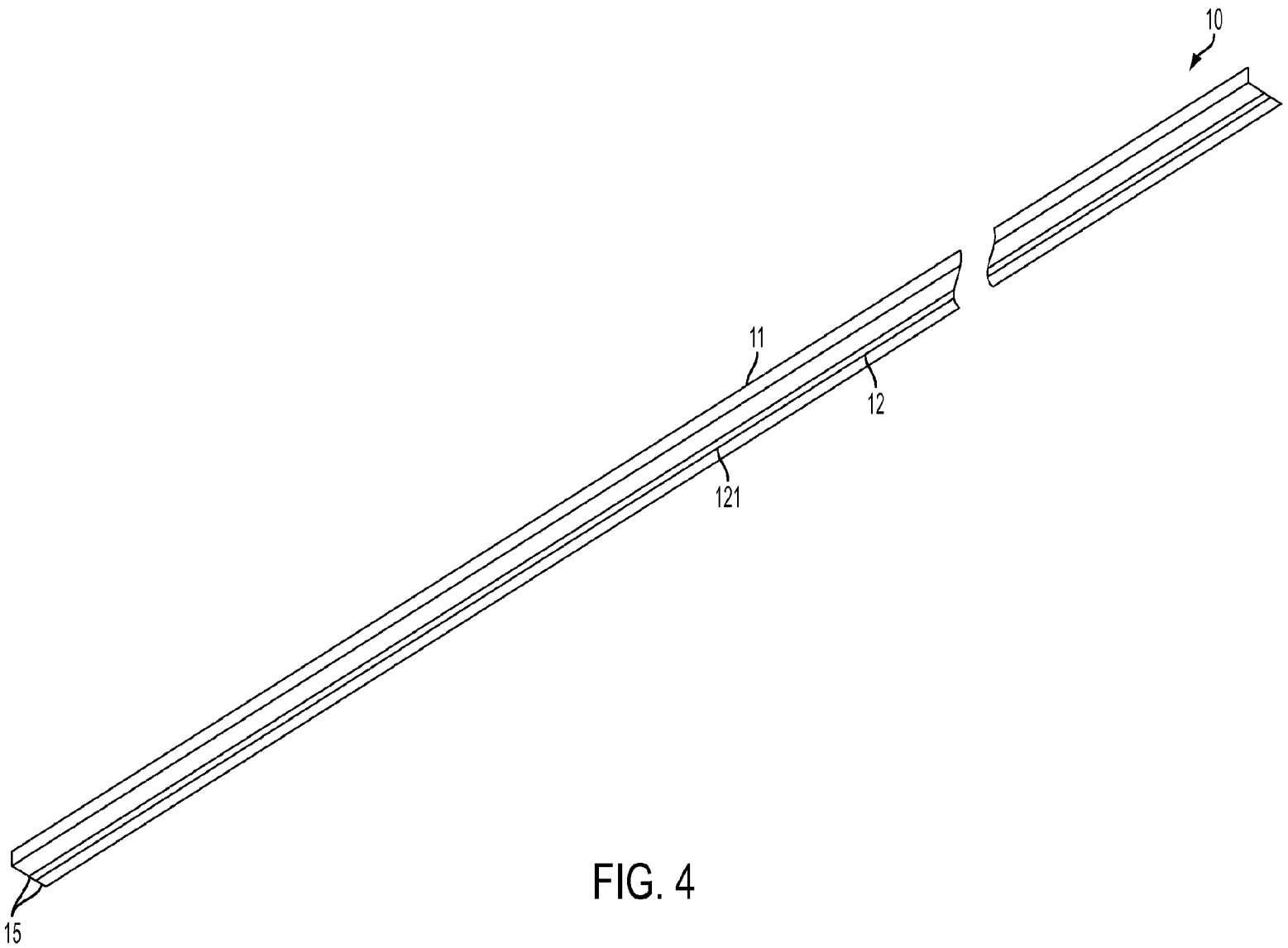
FIG. 4 is another perspective view of the side valance of the present invention.

FIG. 4 shows one embodiment of the side valance 10 in full view. From here it can be seen that side valance 10 comprises an extruded member of any desired length or dimension. The side valance 10 can be constructed of any suitable opaque light-blocking material such as metal, plastic, wood, or combinations thereof and it may be pre-painted a desired color or may be of such a material that is suitably paintable. The dimensions of the side valance are not limiting, however by way of example, a standard side valance 10 may be 60 inches long and have a ½" wide mounting face 11 and a 2" wide retaining face 12. In this example, the width adjustment notches 15 may be located such that the retaining face 12 can be adjusted to a width of ½" and 1" depending on which width adjustment notch 15 is used as a break point. In this configuration the notches are ½" apart with the outermost notch ½" from the outer edge 121 of the retaining face 12. The length adjustment notches 16 can be at any desired increment such as 12" to allow the 60 inch side valance to be adjusted to 48", 36", 24" and so on. In another example, the length of the side valance 10 may be 72 inches and adjustable by length adjustment notches 16 to 60", 48", and 36".

Figure 5:
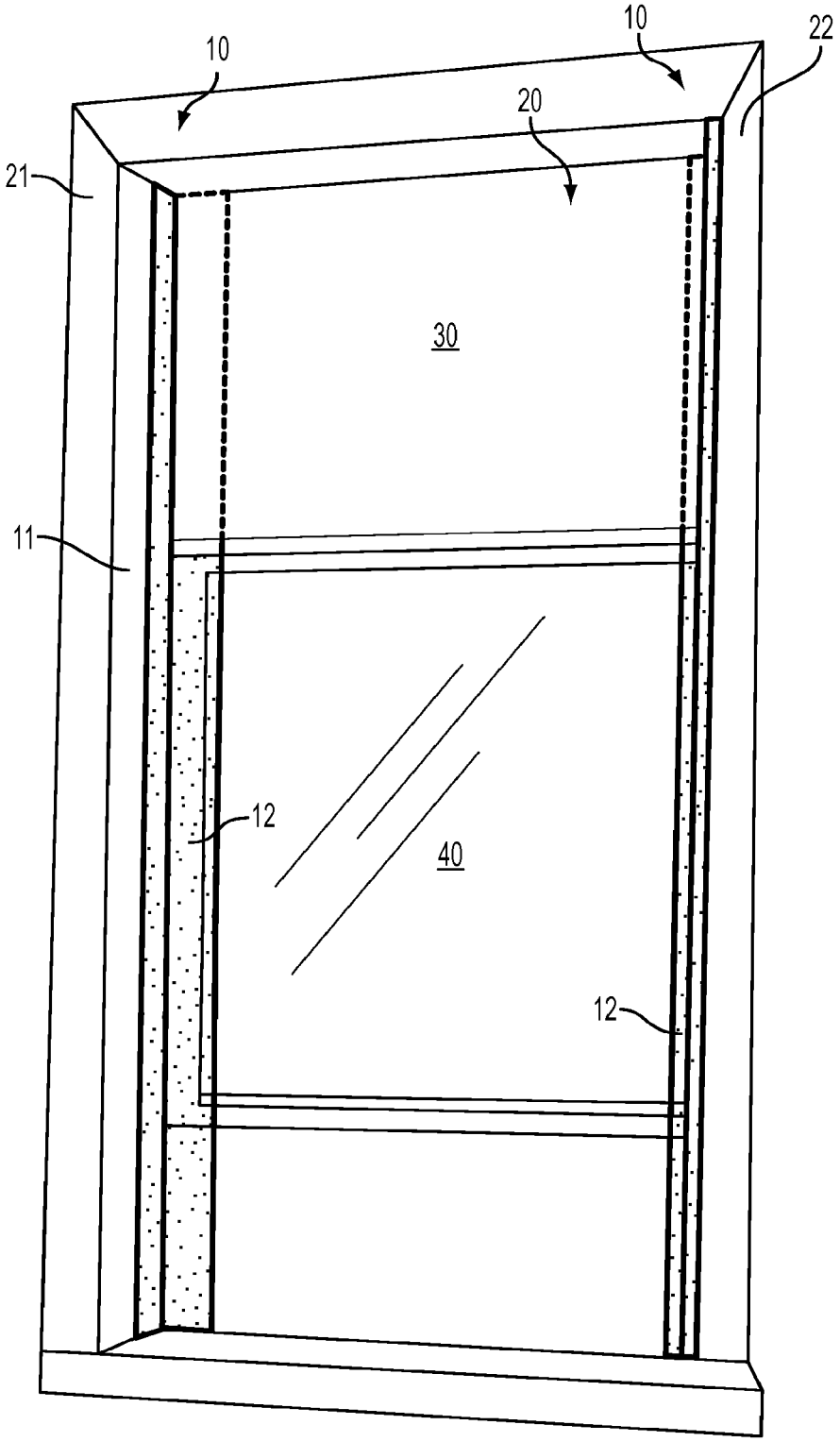
FIG. 5 shows the side valance in use with an exemplary window treatment.

FIG. 5 depicts one application of the side valance of the present invention in use with a window treatment to block light from passing through at the sides of the window treatment. Here it can be seen that two side valances 10 are employed and attached to either side of a window opening 20 that has a blind 30 disposed therein. The mounting face 11 of the side valances 10 is attached to the side walls 21 and 22 of the window opening 20, respectively by known means such as a screw, nail, rivet, adhesive, double-sided tape, or the like. The side valances 10 are oriented such that once attached to the window opening, the retaining face 12 extends slightly into the window opening creating a light blocking and retaining trim feature for the blind 30. In a preferred embodiment, the side valance 10 is such that the retaining face 12 is offset inside the window opening. The blind 30 is installed and oriented such that it rides on the outside of the retaining face 12 such that the retaining face 12 is disposed between the window 40 and the blind 30. The protective material 14 prevents damage to the blind 30 from repeated reciprocation over the side valance 10. As such, the side valance 10 is dual purpose by, primarily, filling the gaps on either side of the blind 30 to prevent light from passing through and, secondarily, by retaining the blind 30 a fixed distance away from the window 40 which prevents the blind 30 from swaying back toward the window. This retaining feature can be helpful with certain window treatments such as blackout shades because it is desired to maintain sufficient distance from the window for optimal light blocking. It is further apparent that because the retaining face 12 is disposed behind the blind 30, the side valance 10 will not interrupt the operation of any type of blind 30 that is utilized whether it be a roller blind, slat blind, roman shade, mini blinds, faux wood and wood, roller shades and roman shades, pleated and honeycomb shades, woven wood/bamboo blinds, window shadings, panel tracks, and vertical blinds. Significantly, because the blind 30 rides in front of the retaining face 12, it can move freely up and down and the blind's slats, if applicable, are free to rotate in any direction as desired. This is a substantial improvement over side channels known in the art that can only be used with roller blinds that have a flat, planar shade. It is further appreciated that the width and length adjustment notches are very useful in fine-tuning the light blocking ability of the side valance, as well as the aesthetics of the overall resultant installation. The width adjustment feature is particularly useful because it 10 allows the side valance 10 to accommodate different sized blinds and the parameters of virtually any window treatment installation. To the extent that the side valance 10 is visible, it can be painted or manufactured in a desired color to match the design of the window treatment or adjacent wall surfaces and other features. Further, the side valance 10 can be easily retrofitted to existing window treatment installations without the need to cut-down or otherwise reconfigure the window treatment itself.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A method of preventing light from passing through a gap between a window frame and a window treatment disposed in the window frame, the window frame having a window opening and vertical sides, the method comprising:

providing an L-shaped light-blocking device with:

a mounting face;

a retaining face extending substantially perpendicular to the mounting face; and at least one frangible width adjustment notch disposed lengthwise along the retaining face; and attaching the mounting face to one of the vertical sides of the window frame to have the retaining face extend from the vertical side between the window treatment and the window opening and block at least some light passing between the window frame and the window treatment.

2. The method according to claim 1, wherein the light-blocking device has:

a longitudinal extent;

a transverse extent; and at least one frangible length adjustment notch disposed across at least a portion of the transverse extent.

3. The method according to claim 1, wherein the mounting face and the retaining face meet at a corner having an interior aspect and further comprising a strip of protective material disposed on the interior aspect of the corner.

4. The method according to claim 1, wherein the retaining face is wider than the mounting face.

5. The method according to claim 1, wherein the at least one frangible adjustment notch is substantially U-shaped and at least partially penetrates the retaining face.

6. The method according to claim 2, wherein the at least one frangible length adjustment notch is disposed across at least one of:

the transverse extent of the mounting face;

the transverse extent of the retaining face; and the transverse extent of both the mounting face and the retaining face.

7. The method according to claim 5, wherein the at least one frangible adjustment notch is formed to break along the notch when a breaking force is applied at the retaining face.

8. The method according to claim 1, wherein the attaching step is performed by attaching the mounting face to one of the vertical sides of the window frame to have the retaining face extend from the vertical side between the window treatment and the window opening and block at least some light passing between the window frame and the window treatment and retain the window treatment at the window frame.

9. The method according to claim 1, further comprising the step of breaking the light-blocking device along the at least one frangible width adjustment notch to reduce a width of the retaining face.

10. The method according to claim 2, further comprising the step of breaking the light-blocking device along the at least one frangible length adjustment notch to adjust a length of the device to fit the vertical side of the window frame.

11. The method according to claim 1, which comprises:

providing two of the light-blocking devices; and attaching the mounting face of each of the light-blocking devices to one of the vertical sides of the window frame to have the retaining face respectively extend from the vertical side between the window treatment and the window opening and block at least some light passing between the window frame and the window treatment.

12. A method of preventing light from passing through a gap between a window frame and a window treatment disposed in the window frame, the window frame having a window opening and vertical sides, the method comprising:

providing a pair of L-shaped light-blocking devices each with:

a mounting face;

a retaining face extending substantially perpendicular to the mounting face; and at least one frangible width adjustment notch disposed lengthwise along the retaining face; and attaching the mounting face of each of the light-blocking devices to one of the vertical sides of the window frame to have the retaining face respectively extend from the vertical side between the window treatment and the window opening and block at least some light passing between the window frame and the window treatment.

13. The method according to claim 12, wherein each of the light-blocking devices has:

a longitudinal extent;

a transverse extent; and at least one frangible length adjustment notch disposed across at least a portion of the transverse extent.

14. The method according to claim 12, wherein the mounting face and the retaining face meet at a corner having an interior aspect and further comprising a strip of protective material disposed on the interior aspect of the corner.

15. The method according to claim 12, wherein the retaining face is wider than the mounting face.

16. The method according to claim 12, wherein the at least one frangible adjustment notch is substantially U-shaped and at least partially penetrates the retaining face.

17. The method according to claim 13, wherein the at least one frangible length adjustment notch is disposed across at least one of:

the transverse extent of the mounting face;

the transverse extent of the retaining face; and the transverse extent of both the mounting face and the retaining face.

18. The method according to claim 16, wherein the at least one frangible adjustment notch is formed to break along the notch when a breaking force is applied at the retaining face.

19. The method according to claim 12, wherein the attaching step is performed by attaching the mounting face to one of the vertical sides of the window frame to have the retaining face extend from the vertical side between the window treatment and the window opening and block at least some light passing between the window frame and the window treatment and retain the window treatment at the window frame.

20. The method according to claim 12, further comprising at least one of the steps of:

breaking the light-blocking device along the at least one frangible width adjustment notch to reduce a width of the retaining face; and breaking the light-blocking device along the at least one frangible length adjustment notch to adjust a length of the device to fit the vertical side of the window frame.

* * * * *